US006023943A

United States Patent [19]

Wang et al.

[11] Patent Number: 6,023,943

[45] Date of Patent: Feb. 15, 2000

[54] CONDENSATING-FRACTIONATING TOWER SYSTEM

[75] Inventors: Songhan Wang; Guanghua Li; Li Li, all of Beijing, China

[73] Assignees: China Petro-Chemical Corporation; Beijing Petrochemical Engineering Company, both of China

[21] Appl. No.: 09/078,601

[22] Filed: May 14, 1998

[30] Foreign Application Priority Data

May 14, 1997 [CN] China ..... CN97111162

[51] Int. Cl.[7] ..... F25J 1/00

[52] U.S. Cl. ..... 62/627; 62/903; 202/158

[58] Field of Search ..... 62/627, 903; 202/158

[56] References Cited

U.S. PATENT DOCUMENTS

| | | | |
|---|---|---|---|
| 1,932,903 | 10/1933 | McKee | 62/627 |
| 5,207,065 | 5/1993 | Lavin et al. | 62/627 |
| 5,505,049 | 4/1996 | Coyle et al. | 62/627 |
| 5,596,883 | 1/1997 | Bernhard et al. | 62/618 |

FOREIGN PATENT DOCUMENTS

| | | |
|---|---|---|
| 5-87447 | 6/1993 | Japan . |
| 6-337192 | 12/1994 | Japan . |
| 6-341760 | 12/1994 | Japan . |

*Primary Examiner*—Ronald Capossela
*Attorney, Agent, or Firm*—Nixon & Vanderhye

[57] ABSTRACT

An improved condensating-fractionating tower system used in the separation of gaseous mixture, comprising a dephlegmator, a column section and a tower bottom, the said dephlegmator being provided in the upper portion of the tower, is characterized in that the dephlegmator is a plate-fin dephlegmator.

8 Claims, 5 Drawing Sheets

CONDENSATING-FRACTIONATING TOWER SYSTEM

FIELD OF THE INVENTION

The present invention relates to an improved separation equipment and the use thereof, more particularly to a condensating-fractionating tower system used in the separation of a gaseous mixture and its application in the separation of hydrocarbon gases.

BACKGROUND OF THE INVENTION

The separation of a gaseous mixture includes heat and mass transfer processes, thus strengthening the heat and mass transfer is very important for improving the separation effect of the gaseous mixture. For example, the cryogenic separation method is frequently used in petrochemical industry in order to separate desired ethylene and propylene products from the cracked gas. In this method the gaseous mixture is cooled or condensed at low temperature and under cryogenic condition by chilling system in series with adding refrigerant, partially liquidified and separated preliminarily into gas and liquid phases, and then the gaseous mixture is further separated via a series of processes such as rectification to yield products of high quality. With this method large amount of refrigeration will be consumed to obtain low temperature and low temperature resistant alloy is needed. In this regards, many improvements on the cryogenic separation process and its equipment have been made in recent ten years to decrease the amount of refrigeration and cut down the investment cost of low temperature equipment, among which one important improvement is employing a dephlegmator to condense a gaseous mixture for strengthening the heat and mass transfer. For example, U.S. Pat. No. 4,657,571 discloses a fractionation column 17 consisting of a dephlegmator 38; Japanese Patent Publication of Unexamination Application Nos. 5-87447, 6-337192 and 6-341760 disclose rectification columns consisting of dephlegmators. In the specifications of these patent and patent applications the details on the types of dephlegmators are not described, in the drawings they are shown as shell and tube types. For this shell and tube dephlegmator the heat and mass transfer effect is not very ideal due to the limited surface area, and it is not easy to control reflux during operation. Especially the operation load can not be very large, otherwise flooding will occur readily. Therefore how to improve the heat and mass transfer in a dephlegmator and increase the separation efficiency of the tower is of essential significance for enhancing the treatment capacity of the tower and lowering the cost.

SUMMARY OF THE INVENTION

After extensively studying on the construction and operation pattern of the dephlegmator, the present inventors discovered that the separation efficiency of a dephlegmator mainly depends on the heat and mass transfer properties of the dephlegmator. Hence the inventors tried to employ various kinds of dephlegmators in a condensating-fractionating tower system and discovered that excellent separation effect can be obtain by using the combination of plate-fin dephlegmator and column section, based on this finding the present invention is accomplished.

Therefor, an object of the present invention is to provide an improved condensating-fractionating tower system which comprises a plate-fin dephlegmator, a column section and a bottom.

Another object of the present invention is to provide use of said improved condensating-fractionating tower system in the separation of a gaseous mixture.

DETAILED DESCRIPTION OF THE INVENTION

The present invention is further described in details below in connection with the drawings.

The term "dephlegmator" used herein means an equipment in which a gaseous mixture is cooled and the high boiling fraction is condensed, which includes various heat exchanger equipments suitable for this purpose.

In the present invention, the gaseous mixture may also include vapour mixture.

Figure 1:
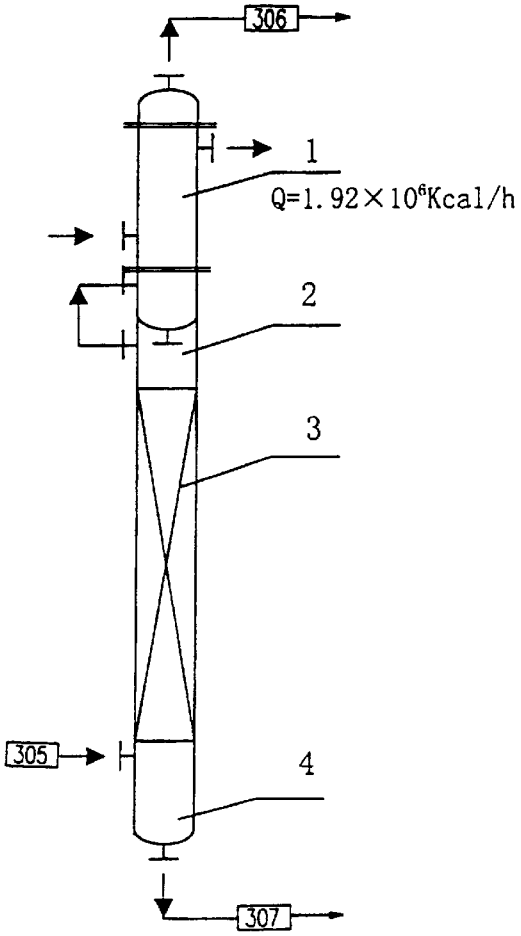
FIG. 1 is a schematic diagram of a condensating-fractionating tower system in one embodiment of the present invention.

As shown in FIG. 1, the condensating-fractionating tower system of the present invention comprises a plate-fin dephlegmator 1, a column section 3 and a tower bottom 4, in which the plate-fin dephlegmator 1 is provided in the upper portion of the tower, the column section 3 is located in the middle portion of the tower and a liquid distributor 2 is set between the plate-fin dephlegmator 1 and the column section 3.

In the present invention plate-fin heat exchanger is used in a plate-fin dephlegmator. Plate-fin heat exchanger is a known equipment which construction can be seen in *China Encyclopedia·Chemical Engineering*, lines 23–28 in column 1 on page 9, China Encyclopedia Publisher, 1987 [which is incorporated herein by reference]. In the present invention, the preferred plate-fin heat exchanger has a heat exchange area of at least $800/m^2/m^3$, most preferably at least 1000 $m^2$ $m^3$. In the plate-fin heat exchanger may be provided multiple passages for streams of refrigerant to pass through, thereby multiple refrigerant streams can pass through simultaneously.

In the condensating-fractionating tower system of the present invention the column section may be of normal structure, such as at least one of sieve tray, floating valve tray, bubble cap tray or packed column, preferably packed column There is no limit for packing material and structure as long as there is no chemical reaction occurring with the gaseous mixture to be separated.

In the condensating-fractionating tower system of the present invention, the tower bottom 4 is set in the bottom of the tower.

Figure 2:
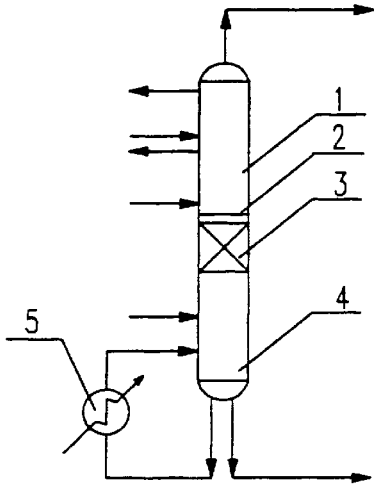
FIG. 2 is a schematic diagram of a condensating-fractionating tower system in another embodiment of the present invention, in which a reboiler is provided.

As shown in FIG. 2, a reboiler 5 may be provided in a condensating-fractionating tower system of one embodiment of the present invention.

Figure 3:
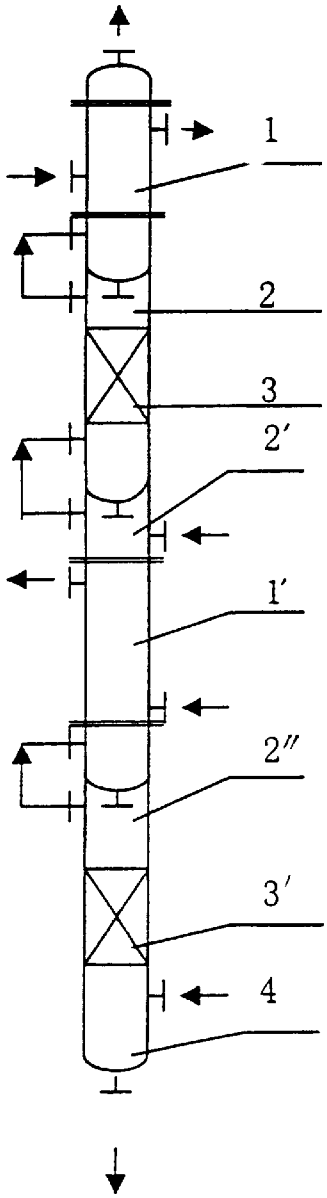
FIG. 3 is a schematic diagram of a condensating-fractionating tower system in still another embodiment of the present invention, in which multiple plate-fin heat exchangers and column sections are provided.
Figure 4:
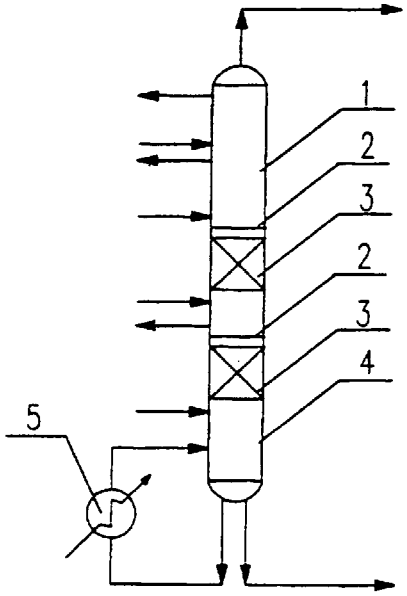
FIG. 4 is a schematic diagram of a condensating-fractionating tower system in still another embodiment of the present invention, in which multiply plate-fin heat exchangers and column sections, as well as reboilers are provided.

As shown in FIG. 3, two sets of dephlegmators and column sections are provided in a condensating-fractionating tower system of another embodiment of the present invention. The whole tower system is formed from top to bottom by a dephlegmator 1, a column section 3, a dephlegmator 1', a column section 3' and a tower bottom 4. In the tower system multiple sets of dephlegmators and column sections may also be provided. All these structures are within the scope of the present invention. As shown in FIG. 4, a reboiler 5 may be set in this kind of the tower system of the present invention.

In the condensating-fractionating tower system of the present invention, raw gas is fed into the column section, refrigerant is entered into the plate-fin heat exchanger. When the gaseous mixture rises in the heat exchanger heavy constituents partially condense, the condensed liquid downflows along the fin plate as film and contacts conversely with the rising gaseous mixture, thus heat and mass transfers are both conducted between the gas and liquid, thereby the separation efficiency is very high. The condensed liquid flew from plate-fin heat exchanger enters into the column section via the liquid distributor, and conducts heat and mass transfer with the rising gas in the column section, thus the separation efficiency is further strengthened. After separation, a gas stream flows out from the outlet on the top of the tower and a liquid stream flows out from the outlet of the tower bottom.

Figure 6:
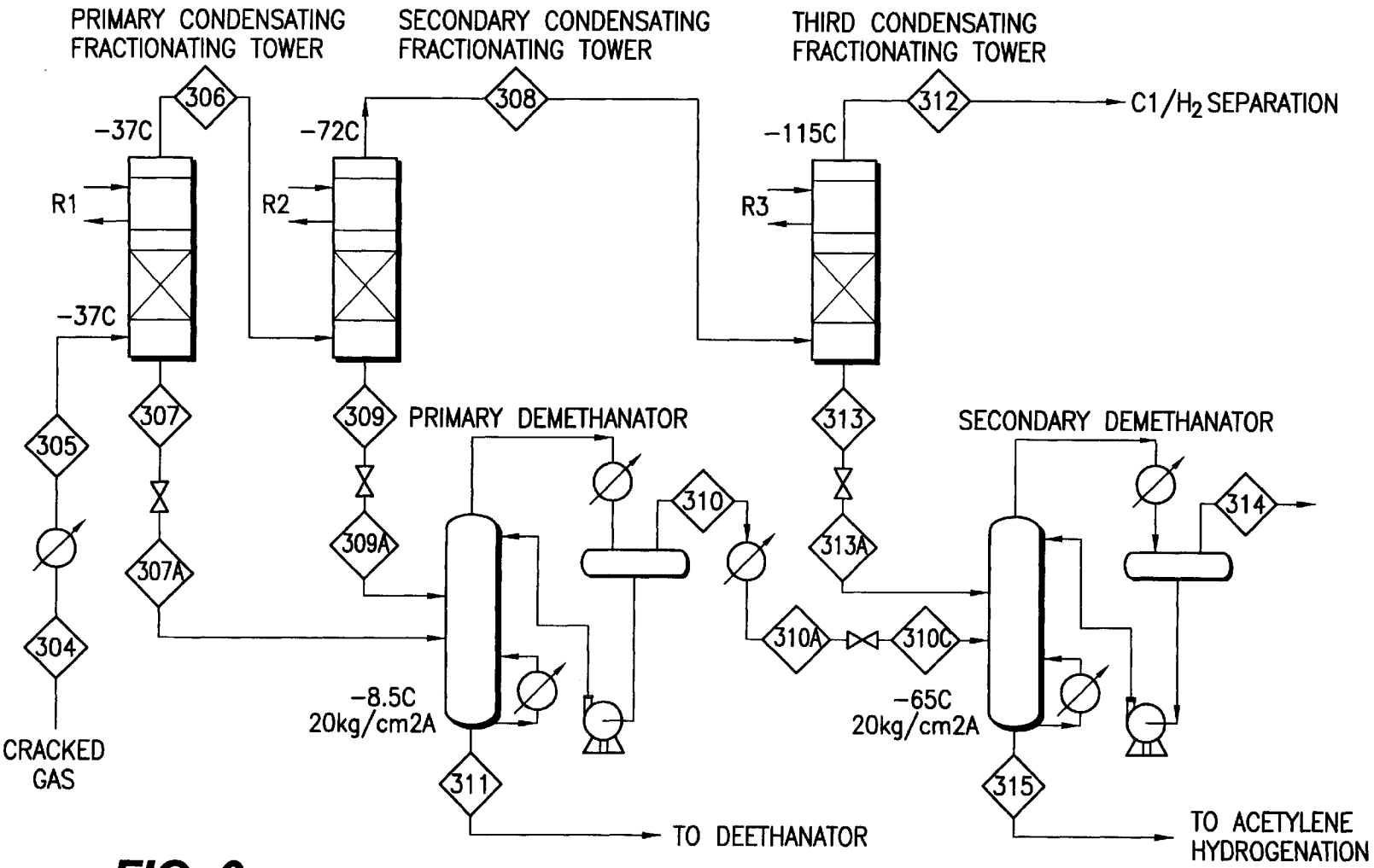
FIG. 6 is a flow diagram for the separation of a cracked gas or hydrocarbon gases in which the condensating-fractionating tower system of the present invention in FIG. 1 is used.

The condensating-fractionating tower system of the present invention may be used in the separation of various gaseous mixtures, for example, they may be connected in series or optionally with other separation equipments to form a separation system. FIG. 6 is a flow diagram of the use of the condensating-fractionating tower system of the present invention in the separation of the cracked gas or hydrocarbon gases. The cracked gas 304 is cooled and condensed via the heat exchanger and passed through three condensating-fractionating towers, the bottom liquids in these three condensating-fractionating towers are used respectively as feedstock for the first and second demethanators (the bottom liquids in two or more condensating-fractionating towers may be used as feedstock for the first and second demethanators). The pressure in the first condensating-fractionating tower is within the range of 3.0 to 3.5 MPa, the top temperature is within the range of −25 to −40° C. and the bottom temperature is within the range of −15 to −25° C. The pressure in the second condensating-fractionating tower is within the range of 3.0 to 3.4 MPa, the top temperature is within the range of −50 to −85° C. and the bottom temperature is within the range of −30 to −50° C. The pressure in the third condensating-fractionating tower is within the range of 2.8 to 3.3 MPa, the top temperature is within the range of −100 to −140° C. and the bottom temperature is within the range of −60 to −90° C. The pressure in the first demethanator is within the range of 1.5 to 2.8 MPa, and the pressure in the second demethanator is within the range of 0.5 to 1.0 MPa. Since the separation capacity of the condensating-fractionating tower is large, the operation conditions of the demethanator are improved, and the refrigerator power can be saved of more than 10% compared with the traditional method.

The present invention will be further described in details in connection with the following examples.

EXAMPLE 1

A gaseous mixture was separated in an improved condensating-fractionating tower system represented in FIG. 1, in which a plate-fin heat exchanger had a heat exchange area of 900 $m^2/m^3$, the packing material was random packing IMTP. No reboiler was provided.

The feed 305 of the following composition (in weight percentage) was fed into the tower system of the present invention at a flow of 147390 kg/hr. The experimental result is listed in Table 1.

TABLE 1

Condensating-Fractionating Tower System Method, wt %

| Stream No. | 305 | 306 | 307 |
|---|---|---|---|
| $H_2$ | 1.24 | 2.35 | 0.06 |
| CO | 0.25 | 0.46 | 0.03 |
| $CH_4$ | 18.82 | 31.79 | 4.93 |
| $C_2$ | 55.45 | 61.96 | 48.48 |
| $C_3$ | 18.20 | 3.44 | 34.00 |
| $C_4$ | 4.89 | 0.00 | 10.13 |
| $C_5$ | 1.15 | 0.00 | 2.37 |
| total | 100 | 100.0 | 100 |
| total flow, kg/hr | 147390 | 76227 | 71163 |
| M | 23.3 | 18.4 | 32.6 |
| Temp., ° C. | −20 | −37 | −20 |

COMPARATIVE EXAMPLE 1

Figure 5:
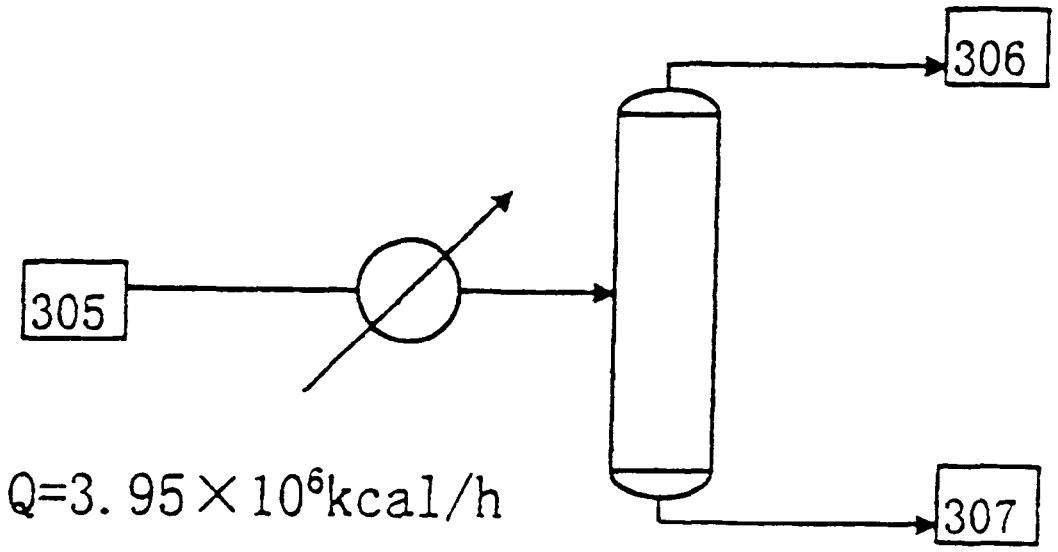
FIG. 5 is a schematic diagram of a combination system of heat exchanger and separation drum in series of the prior art.

The feed 305 was same as that in example 1 which was fed at a flow of 147390 kg/hr and at a temperature of −20° C. The tower system was a combination of heat exchanger and separation drum in series of the prior art as shown in FIG. 5. The separation result is listed in Table 2.

TABLE 2

Traditional Method, wt %

| Stream No. | 305 | 306 | 307 |
|---|---|---|---|
| $H_2$ | 1.24 | 3.05 | 0.07 |
| CO | 0.25 | 0.57 | 0.04 |
| $CH_4$ | 18.82 | 36.93 | 7.03 |
| $C_2$ | 55.45 | 54.21 | 56.26 |
| $C_3$ | 18.20 | 4.89 | 26.86 |
| $C_4$ | 4.89 | 0.33 | 7.86 |
| $C_5$ | 1.15 | 0.02 | 1.88 |
| total | 100 | 100 | 100 |
| total flow, kg/hr | 147390 | 58133 | 89257 |
| M | 23.3 | 17.0 | 30.7 |
| Temp., ° C. | −20 | −37 | −37 |

It can be seen from the Table that with the same feedstock the outcoming gas separated from the tower of the prior art is 58133 kg/hr, whereas it is 76227 kg/hr from the condensating-fractionating tower system of the present invention, which is about 30% higher than that of the prior art. Meanwhile the outcoming liquid from the condensating-fractionating tower system of the present invention contains more heavy constituents and the amount of refrigeration needed is over 10% less than that of the tower of the prior art.

EXAMPLE 2

This example is to illustrate the use of a condensating-fractionating tower system of the present invention in the separation of the cracked gas.

As shown in FIG. 6 the cracked gas at a pressure of 3.48 MPa and a temperature of −20° C. was cooled and condensed via the heat exchanger, and passed through three condensating-fractionating towers. The pressure in the first condensating-fractionating tower was within the range of 3.0 to 3.5 MPa, the top temperature was within the range of −25 to −40° C. and the bottom temperature was within the range of −15 to −25° C. The pressure in the second condensating-fractionating tower was within the range of 3.0 to 3.4 MPa, the top temperature was within the range of −50 to −85° C. and the bottom temperature was within the range of −30 to −50° C. The pressure in the third condensating-fractionating tower was within the range of 2.8 to 3.3 MPa, the top temperature was within the range of −100 to −140° C. and the bottom temperature was within the range of −60 to −90° C. The bottom liquid in these three condensating-fractionating towers were used respectively as feed for the first and second demethanators. The pressure in the first demethanator was within the range of 1.5 to 2.8 MPa, and the pressure in the second demethanator was within the range of 0.5 to 1.0 MPa. In Table 3 are listed compositions of cracked gases at 304, 311, 312, 314 and 315 points of the condensating-fractionating tower. It can be seen from Table 3 that separated $H_2$ and $CH_4$ are of about 2083 kg-mol/hr.

TABLE 3

| Temperature, Pressure, Flow and Composition of Main Streams of the Condensating-Fractionating Tower | | | | | |
|---|---|---|---|---|---|
| Stream No. | 304 | 311 | 312 | 314 | 315 |
| Phase | Feed | 1st demethanator bottom | 3rd condensating-fractionating tower overhead | 2nd demethanator overhead | 2nd demethanator bottom |
| | mixed | liquid | vapor | vapor | liquid |
| | | composition in percentage: | | | |
| hydrogen | 15.16 | 0 | 43.38 | 7.25 | 0 |
| methane | 28.00 | 0.01 | 56.16 | 92.38 | 0.01 |
| ethylene | 34.00 | 49.04 | 0.30 | 0.29 | 92.74 |
| ethane | 7.77 | 16.01 | 0 | 0 | 6.74 |
| propylene | 10.92 | 25.40 | 0 | 0 | 0 |
| $C_4$ | 4.15 | 9.54 | 0 | 0 | 0 |
| total flow kg-mol/hr | 6263.0 | 2670.17 | 2082.74 | 631.44 | 877.70 |
| temp. ° C. | −12.8 | −8.41 | −114.67 | −134.78 | −65.40 |
| pressure, kg/cm$^2$ | 34.85 | 20.24 | 32.22 | 6.08 | 6.11 |

COMPARATIVE EXAMPLE 2

Figure 7:
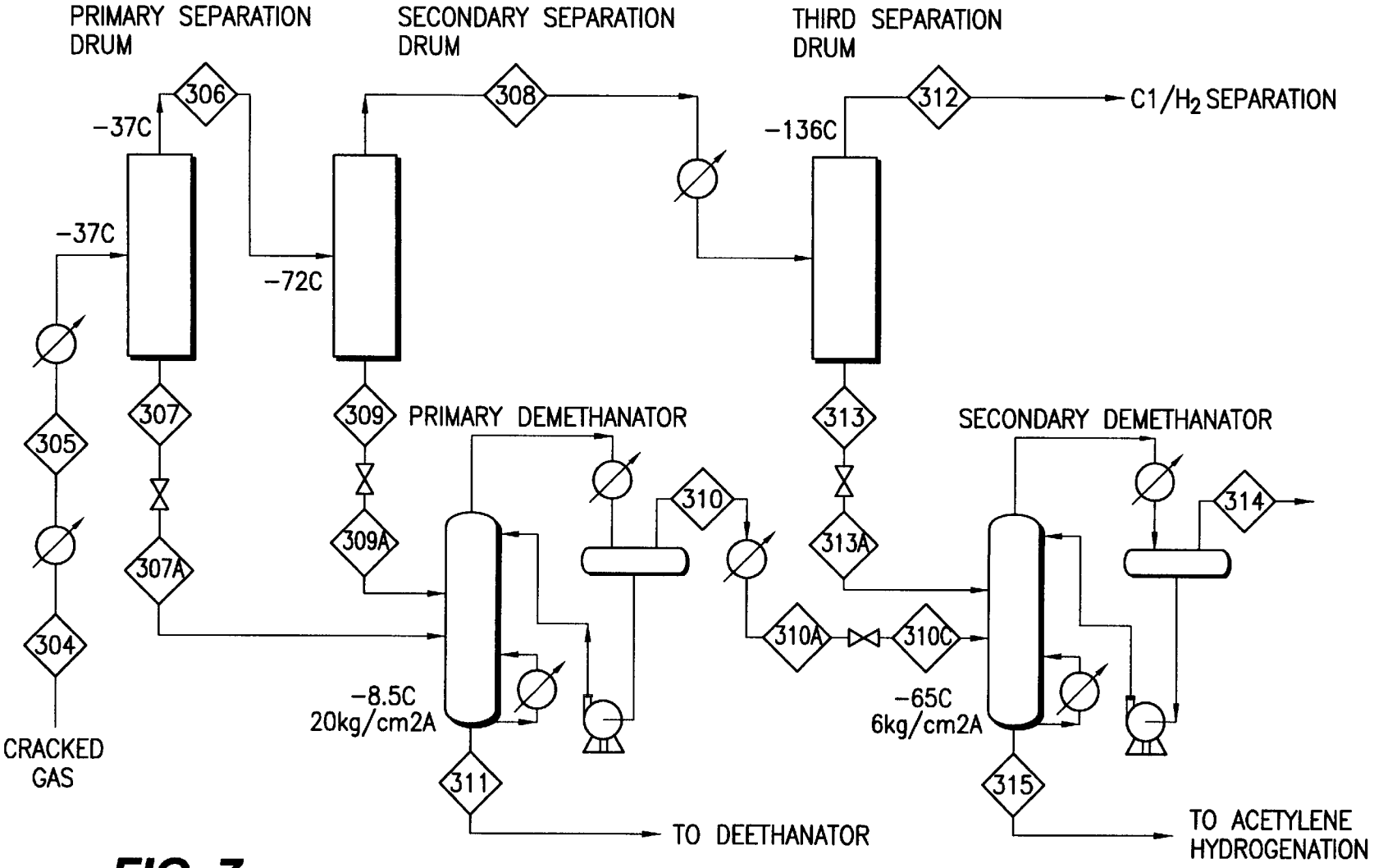
FIG. 7 is a traditional flow diagram for the separation of cracked gas or hydrocarbon gases.

Separation was carried out in a flow diagram in FIG. 7 which was similar to that in FIG. 6 under similar condition except that a separation tank was used instead of a condensating-fractionating tower. The experiment result is shown in Table 4.

TABLE 4

| Temperature, Pressure, Flow and Composition of Main stream of the Normal Separation Process | | | | | |
|---|---|---|---|---|---|
| Stream No. | 304 | 311 | 312 | 314 | 315 |
| Phase | feedstock | 1st demethanator bottom | 3d separation drum overhead | 2nd demethanator overhead | 2nd demethanator bottom |
| | mixed | liquid | vapor | vapor | liquid |
| | | composition in percentage: | | | |
| hydrogen | 15.16 | 0 | 81.5 | 4.9 | 0 |
| methane | 28.00 | 0.01 | 18.2 | 94.7 | 0 |
| ethylene | 34.00 | 55.5 | 0.30 | 0.30 | 91.5 |
| ethane | 7.77 | 14.6 | 0 | 0 | 7.8 |
| propylene | 10.92 | 22.4 | 0 | 0 | 0.7 |
| $C_4$ | 4.15 | 7.5 | 0 | 0 | 0 |
| total flow kg-mol/hr | 6263.0 | 3054 | 1069 | 1645 | 495 |
| temp. ° C. | −12.8 | −8.41 | −114.67 | −134.78 | −65.40 |
| pressure, kg/cm$^2$ | 34.85 | 20.24 | 32.22 | 6.08 | 6.11 |

It can be seen from Table 4 that the outcoming $H_2$ and $CH_4$ separated from the traditional separation process are of only 1069 kg-mol/hr, which is half as many as from the condensating-fractionating tower of the present invention. Obviously, the condensating-fractionating tower of the present invention improves the operation condition of the demethanator, and makes it possible to save of more than 10% of refrigerator power.

Symbols in the drawings

1. plate-fin heat exchanger

2. liquid distributor

3. column section

4. bottom

5. reboiler

What is claimed is:

1. An improved condensating-fractionating tower system for separating a gaseous mixture, comprising a dephlegmator fixed by a flange joint to an internal wall of an upper portion of the tower, a column section below the dephlegmator located by supporting elements in a middle portion of the tower, a liquid distributor arranged between the dephlegmator and the column, and a tower bottom, wherein the dephlegmator is a plate-fin dephlegmator.

2. A condensating-fractionating tower system according to claim 1, including at least one further combination of a dephlegmator, and a column section.

3. A condensating-fractionating tower system according to claims 1 or 2, further comprising a reboiler outside and in fluid communication with the tower body.

4. A condensating-fractionating tower system according to claims 1 or 2, wherein the heat exchange area of the said plate-fin dephlegmator is at least 800 $m^2/m^3$.

5. A condensating-fractionating tower system according to claim 4, wherein the heat exchange area of the said plate-fin dephlegmator is at least 1000 $m^2/m^3$.

6. A condensating-fractionating tower system according to claims 1 or 2, wherein in said plate-fin dephlegmator is provided with multiple passages for streams of refrigerant to pass through.

7. A condensating-fractionating tower system according to claims 1 or 2, wherein the column section is at least one selected from the group consisting of a sieve tray column, a floating valve column, a bubble cap column and a packed column.

8. A condensating-fractionating tower system according to claim 7, wherein the column section is a packed column.

* * * * *